US011365930B2

(12) United States Patent
Clark et al.

(10) Patent No.: US 11,365,930 B2
(45) Date of Patent: Jun. 21, 2022

(54) REMOVABLE DOOR BIN HEIGHT EXTENDER FOR REFRIGERATOR

(71) Applicants: BSH Home Appliances Corporation, Irvine, CA (US); BSH Hausgeräte GmbH, Munich (DE)

(72) Inventors: Jason Clark, Huntington Beach, CA (US); Xuewen Hu, Irvine, CA (US); Graham Sadtler, Huntington Beach, CA (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/090,936

(22) Filed: Nov. 6, 2020

(65) Prior Publication Data

US 2022/0142367 A1 May 12, 2022

(51) Int. Cl.

| | |
|---|---|
| ***F25D 23/04*** | (2006.01) |
| ***F25D 25/02*** | (2006.01) |
| ***A47B 96/02*** | (2006.01) |
| ***A47B 96/16*** | (2006.01) |

(52) U.S. Cl.

CPC ..... *F25D 23/04* (2013.01); *A47B 96/025* (2013.01); *A47B 96/16* (2013.01); *A47B 2220/0061* (2013.01); *A47B 2230/16* (2013.01)

(58) Field of Classification Search

CPC ... A47B 96/025; A47B 96/16; A47B 2230/16; F25D 23/04

See application file for complete search history.

(56) References Cited

U.S. PATENT DOCUMENTS

| | | | | | |
|---|---|---|---|---|---|
| 2,434,117 | A | * | 1/1948 | Money | F25D 25/02 312/293.2 |
| 3,220,558 | A | * | 11/1965 | Olsson | F25D 23/04 211/74 |
| 3,709,576 | A | * | 1/1973 | Lemoine | F25D 25/02 312/321.5 |
| 5,160,191 | A | | 11/1992 | Holland et al. | |
| 5,322,366 | A | * | 6/1994 | Revlett | F25D 23/04 248/221.11 |
| 5,567,029 | A | * | 10/1996 | Haenisch | F25D 23/04 211/100 |
| 5,685,624 | A | | 11/1997 | Lee | |

(Continued)

FOREIGN PATENT DOCUMENTS

| | | | | | |
|---|---|---|---|---|---|
| CN | 2903839 | Y | * | 5/2007 | F25D 23/04 |
| CN | 202371967 | U | * | 8/2012 | F25D 23/04 |
| WO | WO-2014090726 | A1 | * | 6/2014 | F25D 23/04 |

*Primary Examiner* — Kimberley S Wright

(74) *Attorney, Agent, or Firm* — Michael E. Tschupp; Andre Pallapies; Brandon G. Braun

(57) ABSTRACT

A removable door bin height extender for a refrigerator door bin of a refrigerator, including: a frame having a front retaining portion that extends to a right side retaining portion and a left side retaining portion; and a pair of spaced apart, plate-shaped gripping fingers that extend downward from a bottom portion of each of the right side retaining portion and left side retaining portion. The pair of spaced apart, plate-shaped gripping fingers on the right side retaining portion and on left side retaining portion of the frame are configured to slide over and grip a right side wall and a left side wall, respectively, of the refrigerator door bin.

15 Claims, 7 Drawing Sheets

(56) References Cited

U.S. PATENT DOCUMENTS

| | | | | |
|---|---|---|---|---|
| 6,039,424 | A * | 3/2000 | Pink | A47B 96/16 211/88.01 |
| 6,186,608 | B1 * | 2/2001 | Pink | F25D 23/04 312/321.5 |
| 6,220,684 | B1 * | 4/2001 | Bent | A47B 96/02 211/88.01 |
| 6,782,710 | B2 * | 8/2004 | Eveland | F25D 11/02 312/404 |
| 7,293,846 | B2 * | 11/2007 | Collins | F25D 23/04 220/661 |
| 7,651,182 | B2 | 1/2010 | Eveland et al. | |
| D661,325 | S | 6/2012 | Yang et al. | |
| 8,562,089 | B2 * | 10/2013 | Collins | A47B 57/586 312/405.1 |
| 10,113,787 | B2 * | 10/2018 | Claass | F25D 25/02 |
| 11,112,166 | B2 * | 9/2021 | Claass | F25D 23/028 |
| 2003/0020384 | A1 * | 1/2003 | Bush | A47B 88/906 312/348.4 |
| 2004/0011075 | A1 * | 1/2004 | Eveland | F25D 23/04 62/441 |
| 2005/0082956 | A1 * | 4/2005 | Leistner | B60N 3/104 312/408 |
| 2006/0082270 | A1 * | 4/2006 | Collins | F25D 23/04 312/405.1 |
| 2008/0067910 | A1 * | 3/2008 | Butler | F25D 25/02 312/408 |
| 2019/0078836 | A1 * | 3/2019 | Claass | F25D 23/04 |

* cited by examiner

REMOVABLE DOOR BIN HEIGHT EXTENDER FOR REFRIGERATOR

FIELD OF THE INVENTION

The present disclosure relates generally to a refrigerator and to refrigerator door bins. More particularly, the present disclosure relates to a removable door bin height extender for a refrigerator door bin of a refrigerator.

BACKGROUND OF THE INVENTION

In general, home or domestic refrigerator appliances typically include one or more door bins on an inner surface of the door or doors for holding foodstuff items such as condiments, soft drinks, milk, wine, and the like.

The refrigerator door bins typically have a bottom wall, a rear wall, a front wall, and opposing side walls. Some refrigerator door bins are removably mounted to the inner surface of the refrigerator door to permit height adjustment thereof, while other refrigerator door bins can be built into or formed in the inner surface or liner of the refrigerator door.

SUMMARY OF THE INVENTION

The present inventors have observed that it is often the case that larger and taller items such as, for example, a large milk container, a tall soft drink bottle, a tall wine bottle can accidentally fall out of a refrigerator door bin if the front wall of the door bin is too short. This is especially true if the refrigerator door is opened very quickly as is often the case when small children jerk the refrigerator door open very quickly and abruptly. When this occurs, larger/taller items stored in the door bin can, for example, fall forward out over the front wall of the door bin and spill or even break when they hit the floor.

An apparatus consistent with the present disclosure is directed to providing a removable door bin height extender for a refrigerator door bin of a refrigerator.

An apparatus consistent with the present disclosure is directed to providing the ability to contain larger and/or taller items in a short height door bin by providing an add-on accessory to increase the height of the door bin.

An apparatus consistent with the present disclosure is directed to providing a door bin height extender that is removably disposed on an existing door bin and adds extra height to the existing door bin.

An apparatus consistent with the present disclosure is directed to providing a removable door bin height extender that can be a one-piece structure formed of co-molded plastic and rubber, where the frame is plastic and each of a pair of spaced apart, plate-shaped gripping fingers includes a rubber gripping layer disposed on an inside surface thereof. The rubber gripping layer serves as rubber grippers in the plate-shaped gripping fingers for gripping a side wall of the door bin.

An apparatus consistent with the present disclosure is directed to providing a removable door bin height extender having plate-shaped gripping fingers that are asymmetrical on opposite sides of the frame for engaging different height side walls of the door bin.

According to one aspect, the present disclosure provides a removable door bin height extender for a refrigerator door bin of a refrigerator, comprising: a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame are configured to slide over and grip a right side wall and a left side wall, respectively, of the refrigerator door bin.

According to another aspect, each of the pair of spaced apart, plate-shaped gripping fingers includes a rubber gripping layer disposed on an inside surface thereof.

According to another aspect, the frame comprises a plastic frame, and wherein the rubber gripping layer is co-molded with the plastic frame so as to form a one-piece, co-molded plastic frame with the rubber gripping layer on the inside surface of each of the pair of spaced apart, plate-shaped gripping fingers.

According to another aspect, a length of the pair of spaced apart, plate-shaped gripping fingers on the right side retaining portion of the frame and a length of the pair of spaced apart, plate-shaped gripping fingers on left side retaining portion of the frame are asymmetrical.

According to another aspect, the present disclosure provides a refrigerator door bin of a refrigerator, comprising: a front wall, a right side wall, a left side wall, and a bottom wall; and a removable door bin height extender which comprises: a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame slide over and grip the right side wall and the left side wall, respectively, of the refrigerator door bin so as to extend a height of the refrigerator door bin.

According to another aspect, each of the pair of spaced apart, plate-shaped gripping fingers includes a rubber gripping layer disposed on an inside surface thereof.

According to another aspect, the frame comprises a plastic frame, and wherein the rubber gripping layer is co-molded with the plastic frame so as to form a one-piece, co-molded plastic frame with the rubber gripping layer on the inside surface of each of the pair of spaced apart, plate-shaped gripping fingers.

According to another aspect, a length of the pair of spaced apart, plate-shaped gripping fingers on the right side retaining portion of the frame and a length of the pair of spaced apart, plate-shaped gripping fingers on left side retaining portion of the frame are asymmetrical.

According to another aspect, the present disclosure provides a refrigerator, comprising: a refrigerator door bin disposed on a door of the refrigerator and including a front wall, a right side wall, a left side wall, and a bottom wall; and a removable door bin height extender which comprises: a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame slide over and grip the right side wall and the left side wall, respectively, of the refrigerator door bin so as to extend a height of the refrigerator door bin.

According to another aspect, each of the pair of spaced apart, plate-shaped gripping fingers includes a rubber gripping layer disposed on an inside surface thereof.

According to another aspect, the frame comprises a plastic frame, and wherein the rubber gripping layer is co-molded with the plastic frame so as to form a one-piece, co-molded plastic frame with the rubber gripping layer on the inside surface of each of the pair of spaced apart, plate-shaped gripping fingers.

According to another aspect, a length of the pair of spaced apart, plate-shaped gripping fingers on the right side retaining portion of the frame and a length of the pair of spaced apart, plate-shaped gripping fingers on left side retaining portion of the frame are asymmetrical.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1A:
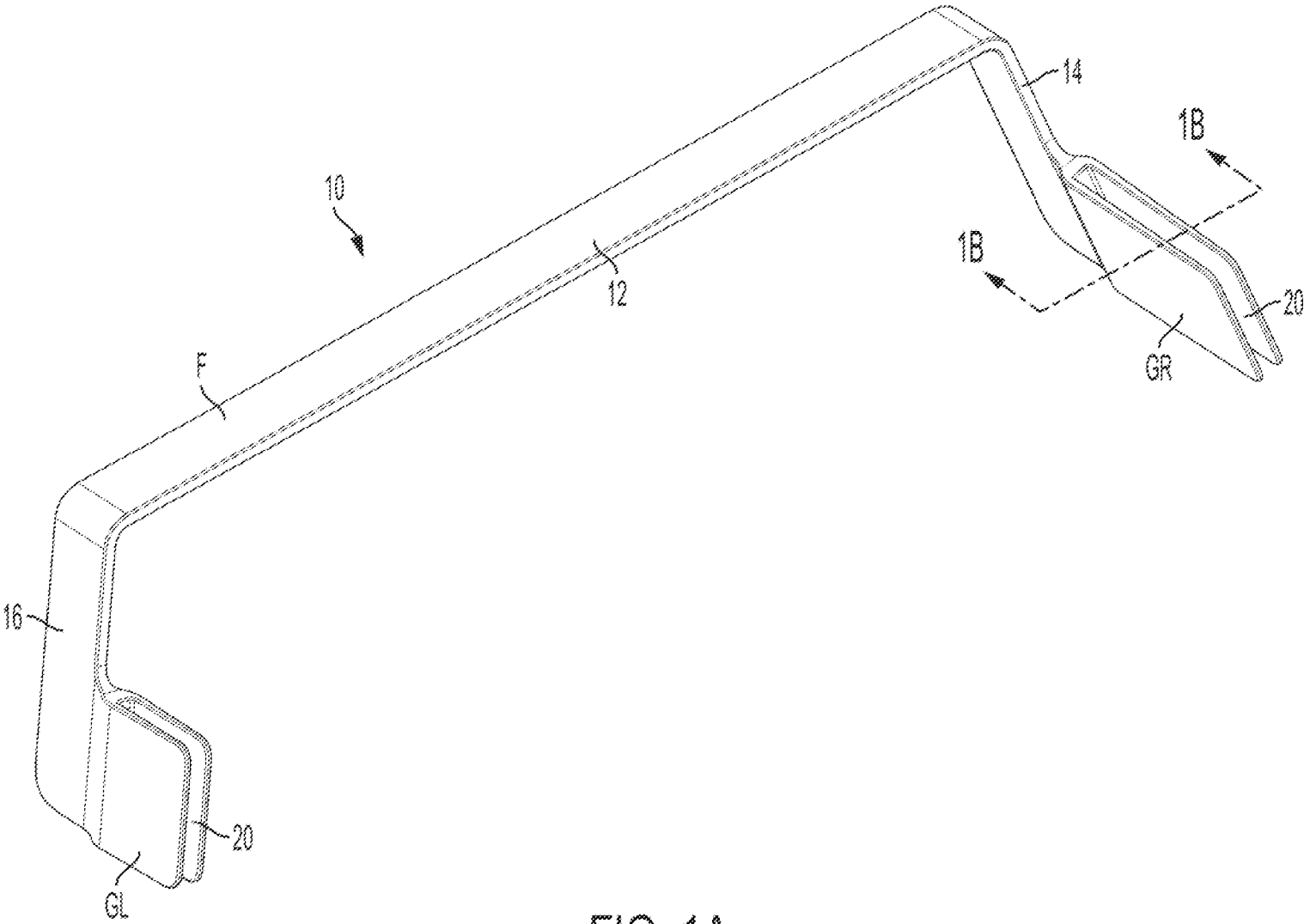
FIG. 1A is a bottom, left-front perspective view of a removable door bin height extender for a refrigerator door bin according to an exemplary embodiment consistent with the present disclosure.
Figure 5:
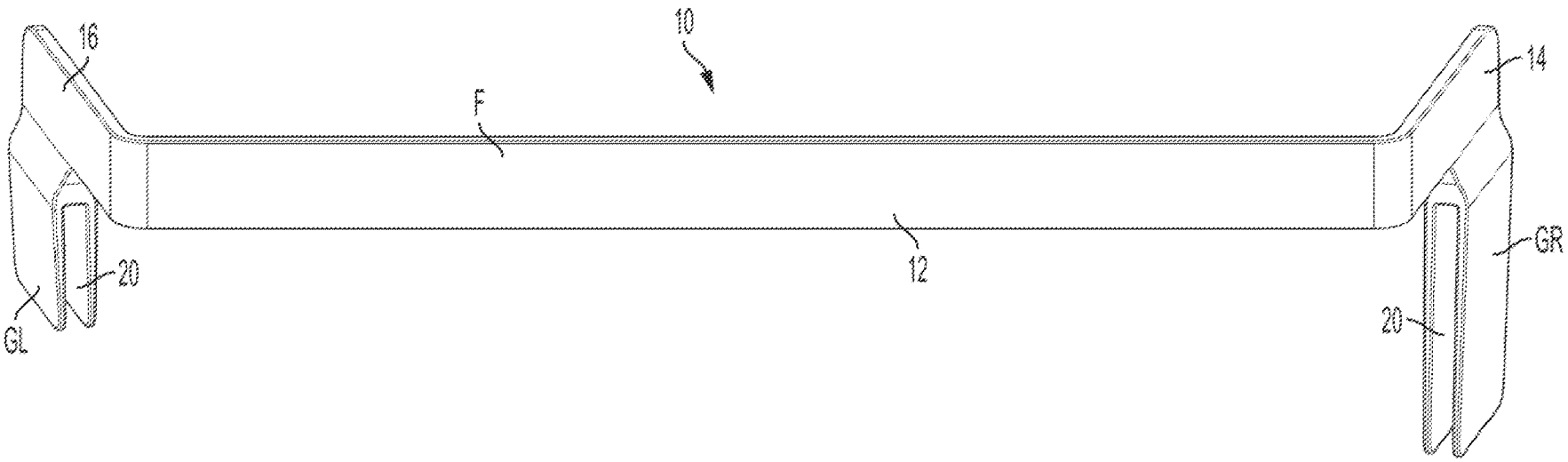
FIG. 5 is a top, front perspective view of a removable door bin height extender for a refrigerator door bin according to an exemplary embodiment consistent with the present disclosure.
Figure 6:
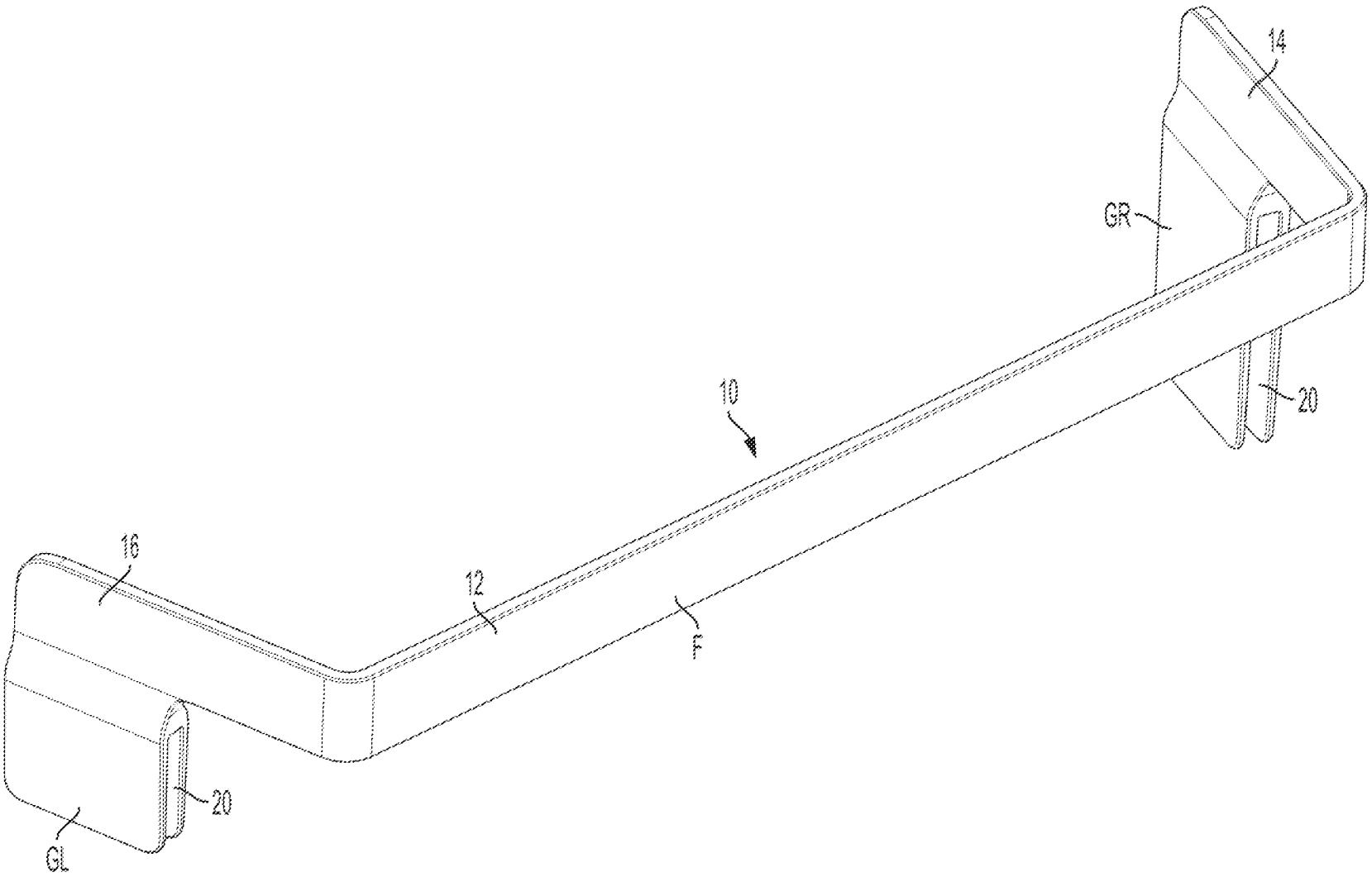
FIG. 6 is a top, left-front perspective view of a removable door bin height extender for a refrigerator door bin according to an exemplary embodiment consistent with the present disclosure.

FIG. 1A is a bottom, left-front perspective view of a removable door bin height extender 10 for a refrigerator door bin according to an exemplary embodiment consistent with the present disclosure. FIGS. 5 and 6 show additional front and top perspective views of the removable door bin height extender 10 for a refrigerator door bin according to an exemplary embodiment consistent with the present disclosure. As shown in FIGS. 1A, 5, and 6, the removable door bin height extender 10 comprises a frame F having a front retaining portion 12 that extends to a right side retaining portion 14 and a left side retaining portion 16. The frame F further includes and a pair of spaced apart, plate-shaped gripping fingers GR and GL that extend downward from a bottom portion of each of the right side retaining portion 14 and left side retaining portion 16, wherein the pair of spaced apart, plate-shaped gripping fingers GR on the right side retaining portion 14 and the pair of spaced apart, plate-shaped gripping fingers GL on left side retaining portion 16 of the frame F are configured to slide over and grip a right side wall and a left side wall, respectively, of the refrigerator door bin, as will be described in detail below.

Figure 1B:
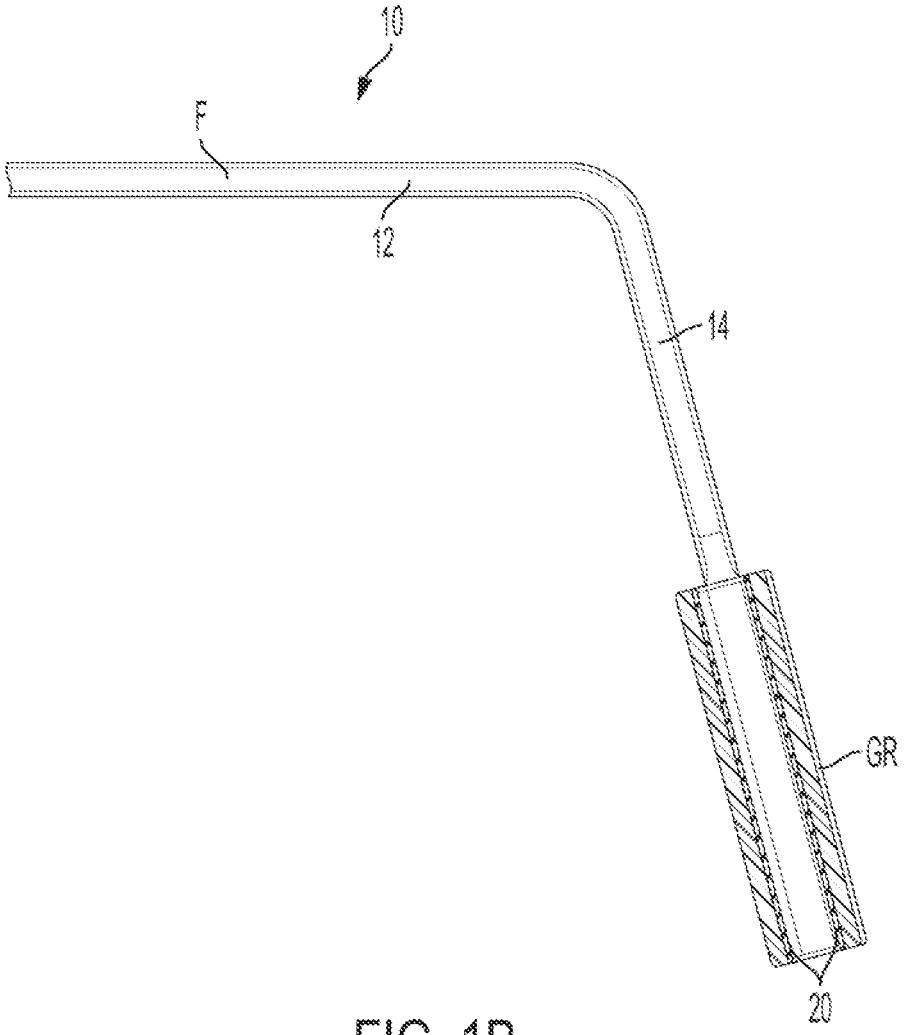
FIG. 1B is a fragmentary view of the removable door bin height extender for a refrigerator door bin showing a sectional view along the lines 1B-1B in FIG. 1A and through one of the pair of spaced apart, plate-shaped gripping fingers according to an exemplary embodiment consistent with the present disclosure.

As shown in FIG. 1B, which a sectional view along the lines 1B-1B in FIG. 1A and through one of the pair of spaced apart, plate-shaped gripping fingers GR, each of the pair of spaced apart, plate-shaped gripping fingers GR and GL includes a rubber gripping layer 20 disposed on an inside surface thereof. More specifically, the frame F comprises a plastic frame formed of, for example, acrylonitrile butadiene styrene (ABS), and the rubber gripping layer 20 is co-molded with the plastic frame so as to form a one-piece, co-molded plastic frame with the rubber gripping layer 20 on the inside surface of each of the pair of spaced apart, plate-shaped gripping fingers GR and GL. The rubber gripping layer 20 can be formed of, for example, thermoplastic elastomers (TPE), also referred to as thermoplastic rubbers.

Figure 2:
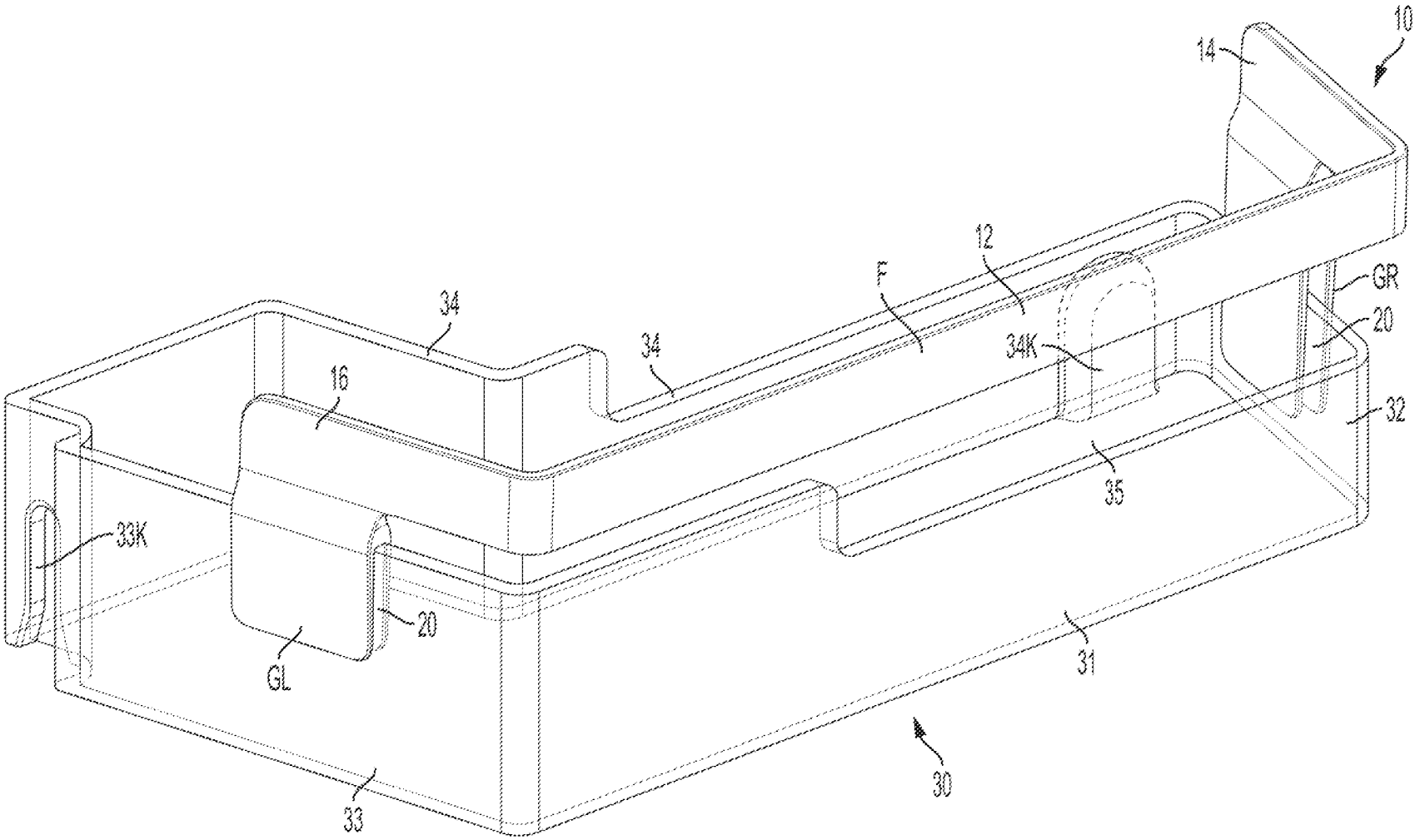
FIG. 2 is a top, left-front perspective view of a removable door bin height extender disposed on a refrigerator door bin having different height side walls according to an exemplary embodiment consistent with the present disclosure.

FIG. 2 is a top, left-front perspective view of the removable door bin height extender 10 disposed on a refrigerator door bin 30 having different height side walls according to an exemplary embodiment consistent with the present disclosure. As shown in FIG. 2, the refrigerator door bin 30 is preferably, but not necessarily, formed of a clear or transparent plastic and includes a front wall 31, a right side wall 32, a left side wall 33, a rear wall 34, and a bottom wall 35. The rear wall 34 can be dispensed with and rear portions of the right and left side walls 32 and 33 can have flange portions in order to mount the refrigerator door bin 30 to an inner surface of the refrigerator door.

As can be seen in FIGS. 1A, 2, 5, and 6, a length of the pair of spaced apart, plate-shaped gripping fingers GR on the right side retaining portion 14 of the frame F and a length of the pair of spaced apart, plate-shaped gripping fingers GL on left side retaining portion 16 of the frame F are asymmetrical. As will be explained in more detail below, this asymmetrical configuration permits the removable door bin height extender 10 to be disposed on a refrigerator door bin having different height side walls such as the refrigerator door bin 30 of FIG. 2 which has the right side wall 32 which is shorter than the left side wall 33.

Figure 3:
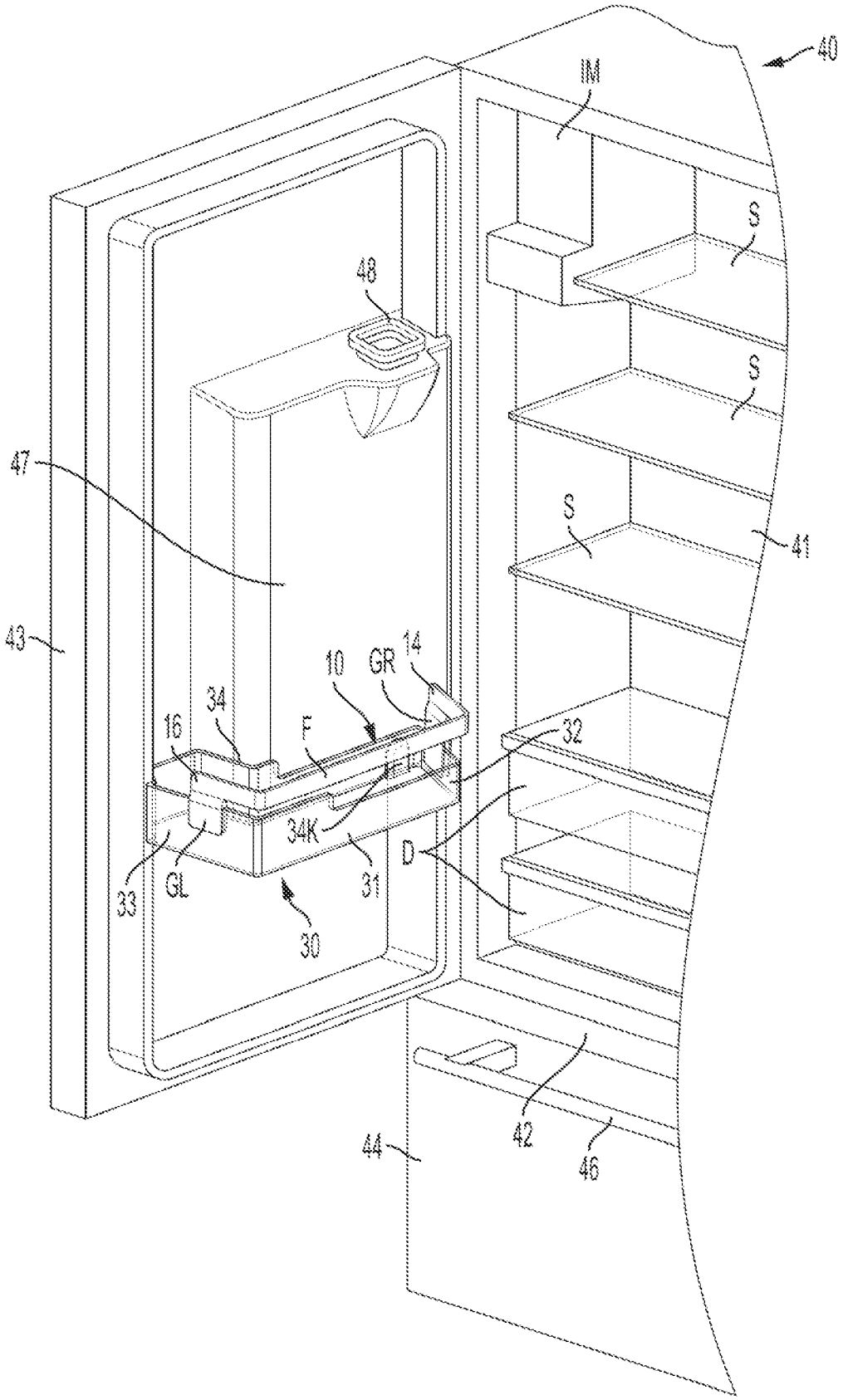
FIG. 3 is a fragmentary, front perspective view of the left side of a refrigerator appliance and showing a removable door bin height extender disposed on a refrigerator door bin having different height side walls according to an exemplary embodiment consistent with the present disclosure.

FIG. 3 is a fragmentary, front perspective view of the left side of the refrigerator appliance 40 and showing a removable door bin height extender 10 disposed on the refrigerator door bin 30 having different height side walls 32 and 33 as shown in detail in FIG. 2. The refrigerator 40 is shown, for example, as a French door—bottom mount (FDBM) type of refrigerator appliance having a fresh food compartment 41 which is closed by a pair of doors 43 (see FIG. 3) and 45 (see FIG. 4) and a bottom freezer compartment 42 having a drawer type door 44 with a handle 46. The fresh food compartment 41 may include one or more shelves S and one or more drawers D. Also, an ice compartment for housing an ice maker (not shown) and storing ice may be disposed in the upper left hand corner. The left side door 43 is shown in an open position and includes a projecting housing portion 47 on an inner liner of the left side door 43 and which accommodates a water and ice dispenser assembly (not visible) accessible by the user on the front side of the left side door 43. An opening 48 of a dispenser ice chute (not visible) for guiding ice from an ice bucket (not shown) in the ice compartment IM to the dispenser is arranged at the top of the projecting housing portion 47. The freezer compartment 42 is typically set at −18° C. or colder, and the fresh food compartment 41 is typically set in a range of 1° C. to 4° C.

As shown in FIGS. 2 and 3, the refrigerator door bin 30 having different height right and left side walls 32 and 33 is configured to fit around the projecting housing portion 47 which extends out away from a remaining portion of the inner liner of the left side door 43. More specifically, the left side wall 33 of the refrigerator door bin 30 may be attached, for example, by a male/female keyway molded into the inner liner of the left side door 43. FIG. 2 shows a female keyway portion 33K, with the male portion (not visible) of the male/female keyway being disposed on the inner liner of the left side door 43. The right side portion of the refrigerator door bin 30 is attached in a similar manner using a male/female keyway (see the female keyway portion 34K in the rear wall 34 near the right side wall 32) except that the refrigerator door bin 30 is also mounted onto the projecting housing portion 47 of the left side door 43 using a fastener such as, for example, a metal screw or bolt (not shown). In use, a user simply positions the refrigerator door bin 30 over the fixation points of the male/female keyways and presses down to lock the refrigerator door bin 30 into place.

Figure 4:
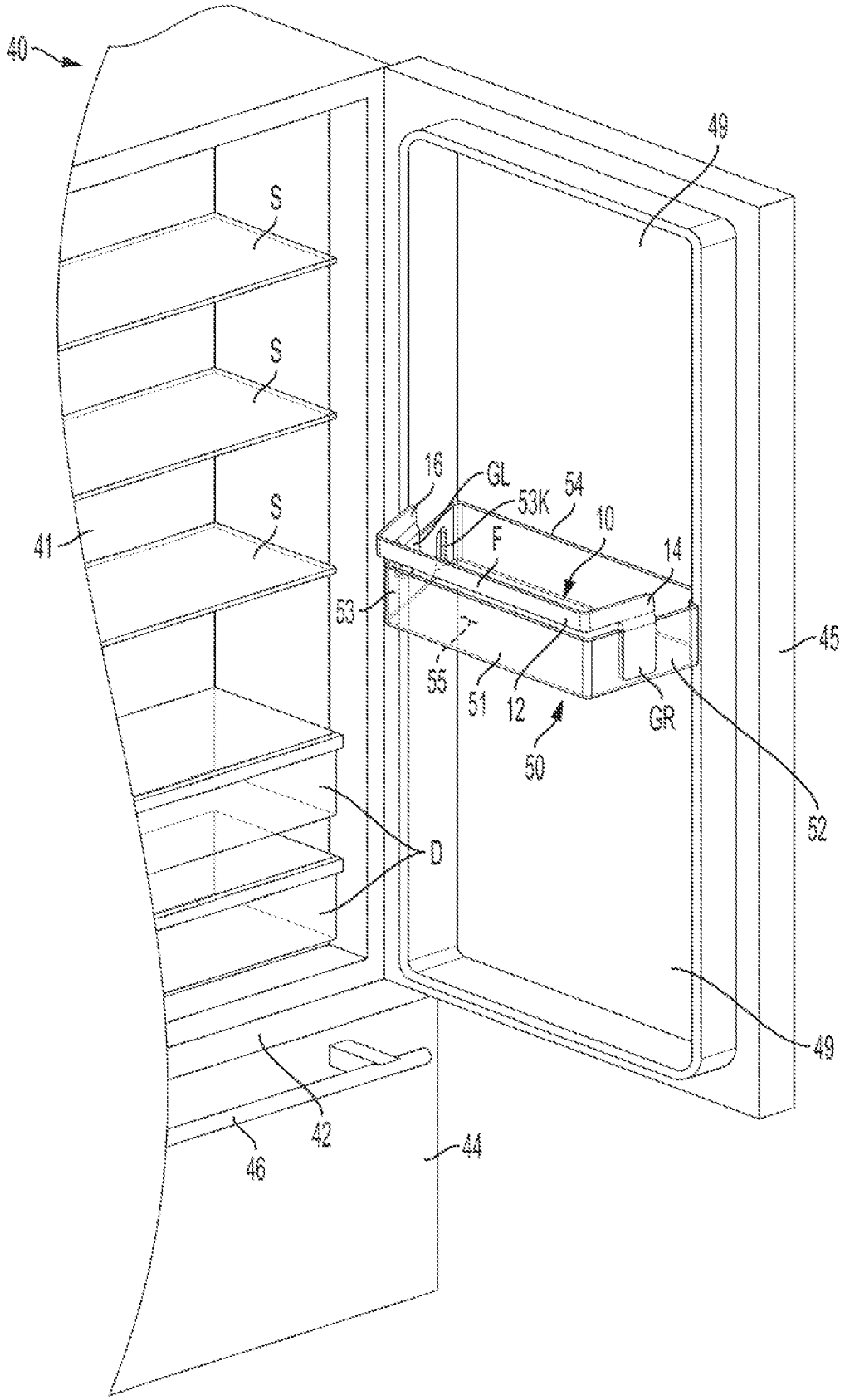
FIG. 4 is a fragmentary, front perspective view of the right side of the refrigerator appliance and showing a removable door bin height extender disposed on a refrigerator door bin having side walls of the same height according to an exemplary embodiment consistent with the present disclosure.

FIG. 4 is a fragmentary, front perspective view of the right side of the same refrigerator appliance 40 of FIG. 3 and showing the removable door bin height extender 10 disposed on a refrigerator door bin 50 having side walls 52 and 53 of the same height. In particular, the right side door 45 is shown in an open position and includes a large open area 49 for positioning one or more of the refrigerator door bins 50. Only one refrigerator door bin 50 is shown for ease of understanding. The refrigerator door bins 50 may be adjustably mounted along the inner liner of the right door 45 for varying the height thereof. The refrigerator door bin 50 is preferably, but not necessarily, formed of a clear or transparent plastic and includes a front wall 51, a right side wall 52, a left side wall 53, a rear wall 54, and a bottom wall 55. The rear wall 54 can be dispensed with and rear portions of the right and left side walls 52 and 53 can have flange portions in order to mount the refrigerator door bin 50 to an inner surface of the right side refrigerator door 45. The refrigerator door bin 50 can also use male/female keyways molded into the inner liner of the right side door 45 similar to the refrigerator door bin 30. FIG. 4 shows a female keyway portion 53K on the left side wall 53, with the male/female keyway on the right side wall 52 not being visible.

When in use, whether the refrigerator door bin has side walls that have different heights as with refrigerator door bin 30, or the refrigerator door bin has side walls that are the same height as with refrigerator door bin 50, the user simply grasps the removable door bin height extender 10 and the slides the pair of spaced apart, plate-shaped fingers GR on the right side retaining portion 14 and the pair of spaced apart, plate-shaped fingers GL on left side retaining portion 16 of the frame F over the right side wall 32, 52 and the left side wall 33, 53, respectively, of the refrigerator door bin 30, 50 so as to grip the right and left side walls of the refrigerator door bin 30, 50. Once in position, the front retaining portion 12 and the right side retaining portion 14 and the left side retaining portion 16 of the frame F of the removable door bin height extender 10 serve to retain larger and taller items such as, for example, a large milk container, a tall soft drink bottle, a tall wine bottle which can otherwise accidentally fall out of a refrigerator door bin especially when the refrigerator door 43, 45 is opened abruptly.

Of course, if the user chooses to not use the removable door bin height extender 10 for any reason, the user can simply lift up the removable door bin height extender 10 and slide it off the side walls of refrigerator door bin 30, 50 and remove it therefrom. Moreover, the user can always purchase the removable door bin height extender 10 as an aftermarket add-on accessory to increase the height of an existing refrigerator door bin.

The present invention has substantial opportunity for variation without departing from the spirit or scope of the present invention. For example, while FIGS. 3 and 4 show a French door-bottom mount (FDBM) style refrigerator, the present invention can be utilized in FDBM configurations having one or more intermediate compartments (such as, but not limited to, pullout drawers) that can be operated as either fresh food compartments or freezer compartments and which are located between the main fresh food compartment and the main freezer compartment, a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, and the like. Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A removable door bin height extender for a refrigerator door bin of a refrigerator, comprising:

a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame are configured to slide over and grip a right side wall and a left side wall, respectively, of the refrigerator door bin, wherein the pair of spaced apart, plate-shaped gripping fingers on the right side retaining portion and on left side retaining portion of the frame are formed as a one-piece structure with the frame, and wherein the pair of spaced apart, plate-shaped gripping fingers on the right side retaining portion has an inverted U-shape when viewed from a front view, and the pair of spaced apart, plate-shaped gripping fingers on the left side retaining portion has an inverted U-shaped when viewed from the front view.

2. The removable door bin height extender of claim 1, wherein each of the pair of spaced apart, plate-shaped gripping fingers includes a rubber gripping layer disposed on an inside surface thereof.

3. The removable door bin height extender of claim 2, wherein the frame comprises a plastic frame, and wherein the rubber gripping layer is co-molded with the plastic frame so as to form a one-piece, co-molded plastic frame with the rubber gripping layer on the inside surface of each of the pair of spaced apart, plate-shaped gripping fingers.

4. The removable door bin height extender of claim 1, wherein a length of the pair of spaced apart, plate-shaped gripping fingers on the right side retaining portion of the frame and a length of the pair of spaced apart, plate-shaped gripping fingers on left side retaining portion of the frame are asymmetrical.

5. A refrigerator door bin of a refrigerator, comprising:

a front wall, a right side wall, a left side wall, and a bottom wall; and a removable door bin height extender which comprises:

a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame slide over and grip the right side wall and the left side wall, respectively, of the refrigerator door bin so as to extend a height of the refrigerator door bin, wherein the pair of spaced apart, plate-shaped gripping fingers on the right side retaining portion and on left side retaining portion of the frame are formed as a one-piece structure with the frame, and wherein the pair of spaced apart, plate-shaped gripping fingers on the right side retaining portion has an inverted U-shape when viewed from a front view, and the pair of spaced apart, plate-shaped gripping fingers on the left side retaining portion has an inverted U-shaped when viewed from the front view.

6. The refrigerator door bin of claim 5, wherein each of the pair of spaced apart, plate-shaped gripping fingers includes a rubber gripping layer disposed on an inside surface thereof.

7. The refrigerator door bin of claim 6, wherein the frame comprises a plastic frame, and wherein the rubber gripping layer is co-molded with the plastic frame so as to form a one-piece, co-molded plastic frame with the rubber gripping layer on the inside surface of each of the pair of spaced apart, plate-shaped gripping fingers.

8. The refrigerator door bin of claim 5, wherein a length of the pair of spaced apart, plate-shaped gripping fingers on the right side retaining portion of the frame and a length of the pair of spaced apart, plate-shaped gripping fingers on left side retaining portion of the frame are asymmetrical.

9. A refrigerator, comprising:

a refrigerator door bin disposed on a door of the refrigerator and including a front wall, a right side wall, a left side wall, and a bottom wall; and a removable door bin height extender which comprises:

a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame slide over and grip the right side wall and the left side wall, respectively, of the refrigerator door bin so as to extend a height of the refrigerator door bin, wherein the pair of spaced apart, plate-shaped gripping fingers on the right side retaining portion and on left side retaining portion of the frame are formed as a one-piece structure with the frame, and wherein the pair of spaced apart, plate-shaped gripping fingers on the right side retaining portion has an inverted U-shape when viewed from a front view, and the pair of spaced apart, plate-shaped gripping fingers on the left side retaining portion has an inverted U-shaped when viewed from the front view.

10. The refrigerator of claim 9, wherein each of the pair of spaced apart, plate-shaped gripping fingers includes a rubber gripping layer disposed on an inside surface thereof.

11. The refrigerator of claim 10, wherein the frame comprises a plastic frame, and wherein the rubber gripping layer is co-molded with the plastic frame so as to form a one-piece, co-molded plastic frame with the rubber gripping layer on the inside surface of each of the pair of spaced apart, plate-shaped gripping fingers.

12. The refrigerator of claim 9, wherein a length of the pair of spaced apart, plate-shaped gripping fingers on the right side retaining portion of the frame and a length of the pair of spaced apart, plate-shaped gripping fingers on left side retaining portion of the frame are asymmetrical.

13. A removable door bin height extender for a refrigerator door bin of a refrigerator, comprising:

a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame are configured to slide over and grip a right side wall and a left side wall, respectively, of the refrigerator door bin, and wherein a length of the pair of spaced apart, plate-shaped gripping fingers on the right side retaining portion of the frame and a length of the pair of spaced apart, plate-shaped gripping fingers on left side retaining portion of the frame are asymmetrical.

14. A refrigerator door bin of a refrigerator, comprising:

a front wall, a right side wall, a left side wall, and a bottom wall; and a removable door bin height extender which comprises:

a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame slide over and grip the right side wall and the left side wall, respectively, of the refrigerator door bin so as to extend a height of the refrigerator door bin, and wherein a length of the pair of spaced apart, plate-shaped gripping fingers on the right side retaining portion of the frame and a length of the pair of spaced apart, plate-shaped gripping fingers on left side retaining portion of the frame are asymmetrical.

15. A refrigerator, comprising:

a refrigerator door bin disposed on a door of the refrigerator and including a front wall, a right side wall, a left side wall, and a bottom wall; and a removable door bin height extender which comprises:

a frame having a front retaining portion that extends to a right side retaining portion and a left side retaining portion; and a pair of spaced apart, plate-shaped gripping fingers that extend downward from a bottom portion of each of the right side retaining portion and left side retaining portion, wherein the pair of spaced apart, plate-shaped gripping fingers on the right side retaining portion and on left side retaining portion of the frame slide over and grip the right side wall and the left side wall, respectively, of the refrigerator door bin so as to extend a height of the refrigerator door bin, and wherein a length of the pair of spaced apart, plate-shaped gripping fingers on the right side retaining portion of the frame and a length of the pair of spaced apart, plate-shaped gripping fingers on left side retaining portion of the frame are asymmetrical.

* * * * *